United States Patent [19]

Foshee

[11] 4,195,504

[45] Apr. 1, 1980

[54] MORTISE LOCK ADAPTATION TO KEY-REMOVABLE CORES

[75] Inventor: William R. Foshee, Indianapolis, Ind.

[73] Assignee: Best Lock Corporation, Indianapolis, Ind.

[21] Appl. No.: 932,557

[22] Filed: Aug. 10, 1978

[51] Int. Cl.[2] ..... E05B 9/10; E05B 17/04

[52] U.S. Cl. ..... 70/369; 70/380; 70/DIG. 60

[58] Field of Search ..... 70/367, 369, 379 R, 70/379 A, 380, DIG. 60

[56] References Cited

U.S. PATENT DOCUMENTS

| | | | |
|---|---|---|---|
| 1,564,463 | 12/1925 | Best | 70/380 |
| 3,945,299 | 3/1976 | Frank | 70/363 |

FOREIGN PATENT DOCUMENTS

| | | | |
|---|---|---|---|
| 1198704 | 8/1965 | Fed. Rep. of Germany | 70/DIG. 60 |
| 2456256 | 8/1976 | Fed. Rep. of Germany | 70/DIG. 60 |

*Primary Examiner*—Robert L. Wolfe

*Attorney, Agent, or Firm*—Jenkins, Coffey, Hyland, Badger & Conard

[57] ABSTRACT

An adaptation for a mortise lock having a double-ended primary lock "cylinder" of "keyhole" cross-section mounted through a conforming opening in the mortise lock case, provides for use of key-removable lock cores and increases security by preventing removal of the lock cylinder except after removal of a core with a special control key. Two key-removable cores are mounted in chambers at opposite ends of a housing which fits through the cylinder-receiving opening of the mortise lock case. A bolt-actuating cam between the chambers lies within the case and is alternatively engaged by shuttle throw plug members respectively moved to engaged position by thrust of a key in one of the cores and is operated by rotation of such key. The cores require a special control key for removal and are shaped or mouned so as to project laterally from the lock cylinder and thereby to block passage of the cylinder out of the conforming opening of the lock case until removed by a control key.

17 Claims, 9 Drawing Figures

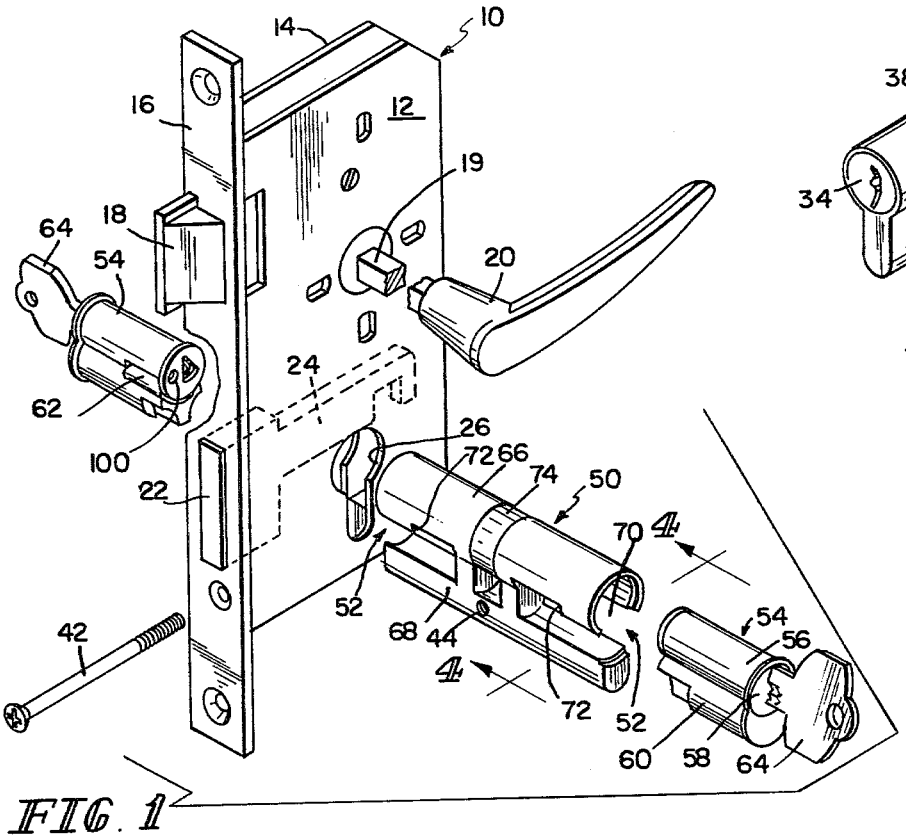
FIG. 1
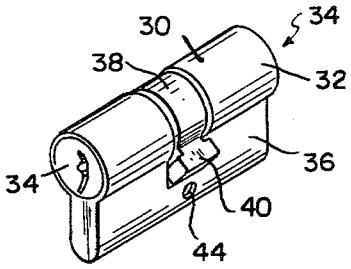
FIG. 2
FIG. 3
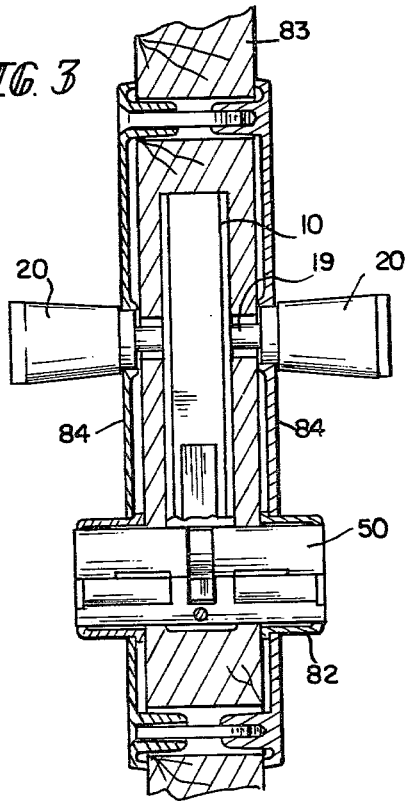
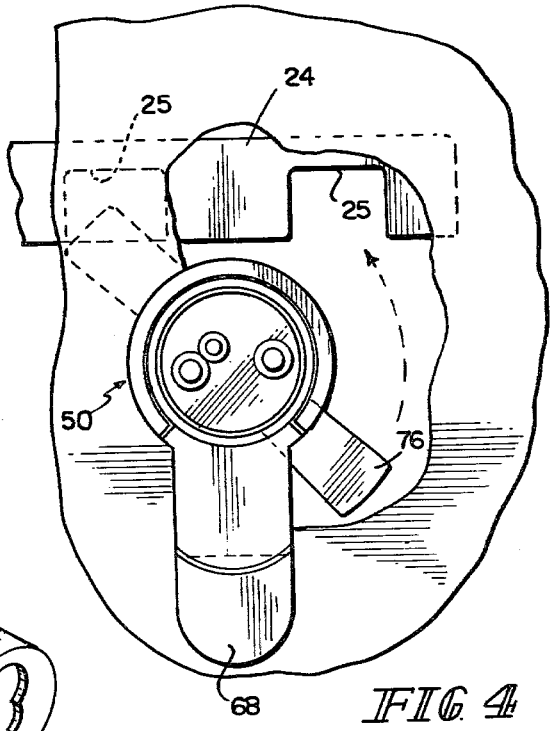
FIG. 4
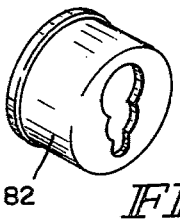
FIG. 5

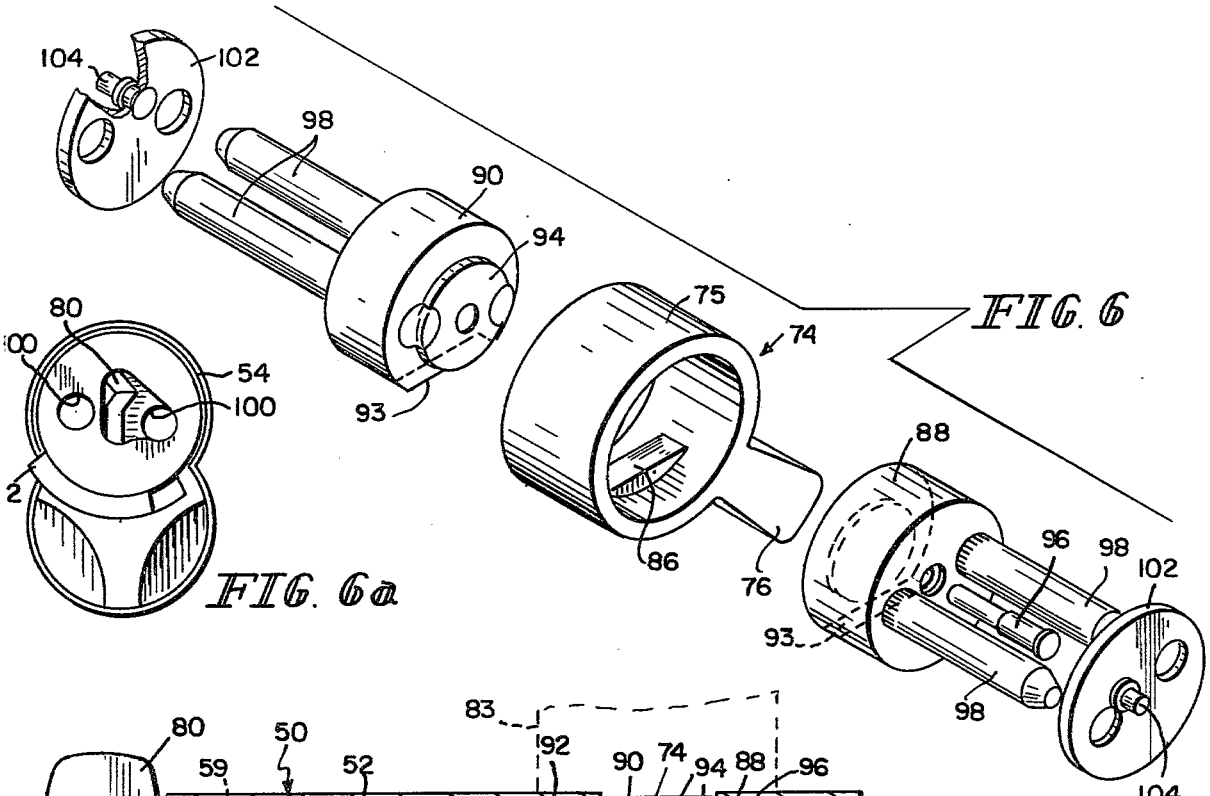
FIG. 6
FIG. 6a
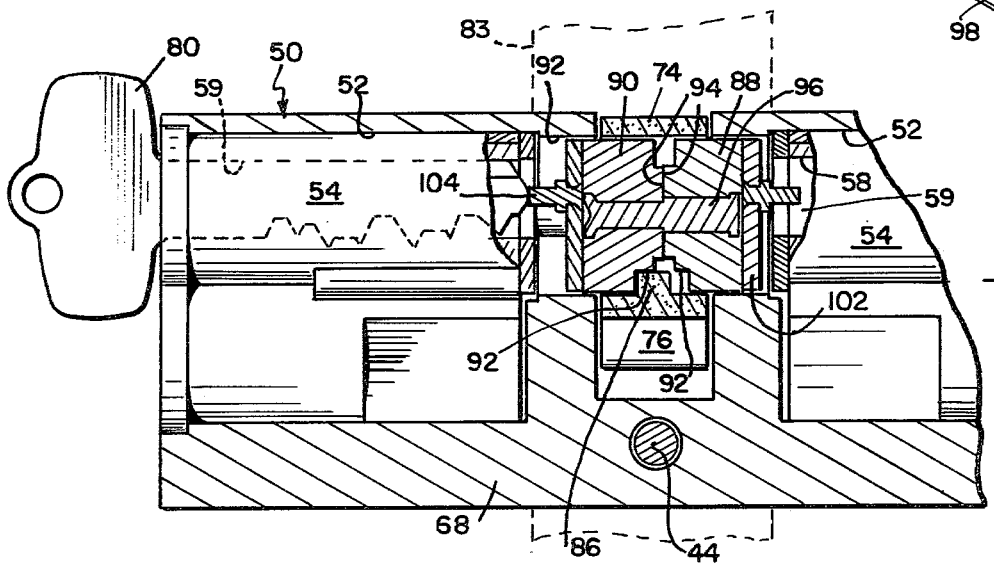
FIG. 7
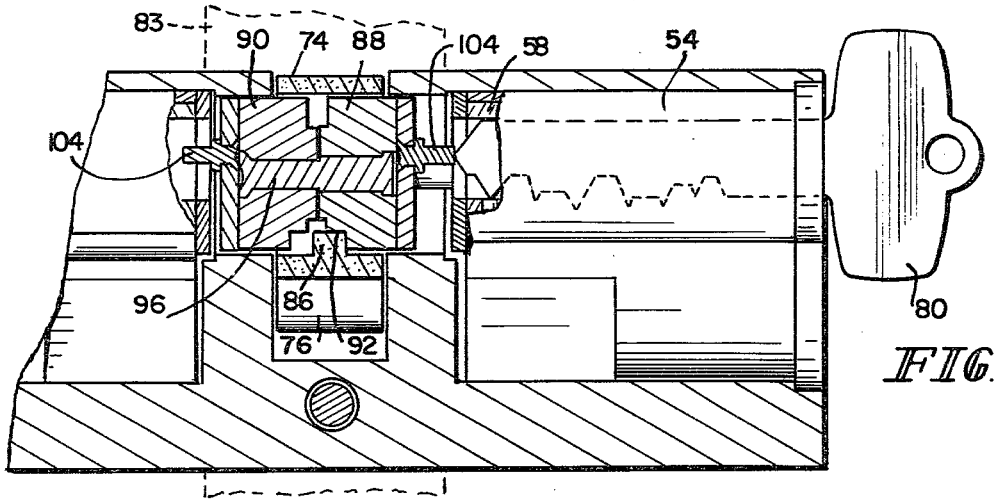
FIG. 8

MORTISE LOCK ADAPTATION TO KEY-REMOVABLE CORES

This invention relates to mortise lock sets for doors, and more particularly to an adaptation for a mortise lock set of a type widely used in Europe in which a double-ended primary lock cylinder is mounted through a conforming opening in the mortise lock case, which adaptation provides for use of key-removable lock cores of a standard configuration and increases the convenience and especially the security of such lock mechanism.

In the known mortise lock mechanism of the type to which this invention relates, the mortise lock case is provided with a through opening of "keyhole" cross section adjacent a bolt which is to be key-actuated. A known primary lock "cylinder" of similar cross-section is positioned through such opening, and has a central bolt-actuating cam operated by key plugs mounted in the opposite ends of the cylinder and controlled by tumbler pins in the bottom flange of the cylinder which is received in the narrow bottom portion of the keyhole-shaped opening. This disposes the two key plugs at opposite sides of the door, and the cam is alternatively operable by key actuation of those two key plugs. The cylinder is held in place by a retaining screw accessible at the edge of the door, and is removable by removing such retaining screw and by actuating the cylinder with any normal operating key in either key plug to rotate the nose of the bolt operating cam into alignment with the lower flange of the cylinder so that it will pass through the keyhole-shaped opening in the case. The cylinder is thus easily removable with the use of any normal operating key. Also, there is no provision for replacement of the key-actuated primary lock mechanism, as to change the combination thereof, except by replacing the entire cylinder.

It has been known for many years in the United States to provide mortise lock cylinders and various other lock housings with interchangeable key-removable cores of a standard configuration, as shown for example by Frank E. Best U.S. Pat. No. 3,206,959 of Sept. 21, 1965. This standard key-removable core is of FIG. 8 cross section and is mounted in a housing having a core chamber of corresponding shape. The core is retained by a retaining lug projecting from the side of the core into engagement behind a shoulder at the side of the chamber, and is removable only by retracting the lug with the use of a special control key. This arrangement provides a ready interchangeability of cores, which is of great advantage, especially when it is desired to change the combinations of a group of locks or of all the locks in a particular installation. It is also of advantage in facilitating the construction and use of a lock system in which a large number of locks at the same or a group of related installations are keyed with a system of master and sub-master keys in addition to operating keys for specific locks. In the installation of such a system, the lock mechanisms can initially be provided with builder's cores combinated for use by the builders of the installation, and the cores can later be replaced in accordance with the desired master system. In such replacement, or in any subsequent replacement to change the combinations of particular groups of locks, it is only necessary to go from lock to lock, and at each to remove the existing core with a control key and replace it with a replacement core. This can be done quickly and easily and requires only a few seconds of time at each lock. This system of key-removable cores has been found to provide substantial advantages, and without enumerating all such advantages, it is sufficient to note that such advantages have not been available with mortise locks of the type discussed above because they were not adapted for use with key-removable cores.

The present invention provides such availability. In accordance with a preferred embodiment of the present invention, a cylinder or housing is provided having a keyhole cross-sectional shape adapted to be inserted in the standard mounting hole of the mortise lock case, and this is provided with a rotatable cam intermediate its ends. The ends of the housing are formed with opposite core-receiving chambers. Each such chamber includes an axial lobe in the upper cylindrical barrel portion of the housing for the reception of the key plug lobe of a key-removable core, preferably a core of FIG. 8 cross section. The bottom of such barrel portion and the upper portion of the longitudinal flange of the housing is cut away to accommodate the lower lobe or pin tumbler housing of the core. The core is mounted, and the FIG. 8 core is formed, so that its pin tumbler housing projects outward from the bottom flange of the housing to block its passage through the keyhole-shaped opening in the mortise lock case. When FIG. 8 cores are in place in both ends of the housing, it is not possible to remove the housing from the mortise lock case without first removing at least one of such cores with the use of a special control key.

A cam-throw shuttle assembly is mounted in the cylinder housing between the axial core chamber lobes, and includes two relatively rotatable throw members, each having a driving clutch element thereon. The bolt-actuating cam is rotatably mounted about the shuttle assembly and has a driven clutch element disposed between the two throw members for alternate engagement by the driving clutch elements of such members as they are alternatively shuttled into engagement therewith. Each rotatable throw member of the shuttle assembly is connected for rotation by the key plug of a core mounted in the adjacent core chamber, preferably by means of a pair of throw pins fixed on the rotatable throw member and received in suitably located holes in the key plug of the core. Such pins and holes allow for axial engagement and disengagement of the key plug with the throw means as the core is inserted in and removed from its core chamber.

For shuttle movement, each shuttle throw member preferably carries a shuttle pin which is positioned in position to be engaged by a key in the key plug of the adjacent core so that insertion of such key will shuttle the assembly so as to clutch the adjacent throw member to the driven clutch element of the bolt-actuating cam and simultaneously disengage the opposite rotatable throw member from the driven element. This will allow the key-containing key plug to be rotated to actuate the bolt-actuating cam independently of the locked core at the opposite end of the housing.

For mounting a cylinder in accordance with the invention in a door having a mortise lock case of the type referred to, the cylinder housing is first fitted with a core at one end, by actuating such core to retract its retaining lug and inserting the core in the chamber at one end of the cylinder housing. The control key is then replaced with an operating key, and this is used to rotate the bolt-actuating cam to bring its lug into alignment with the flange at the bottom of the cylinder housing.

The housing can then be inserted in the standard opening of the mortise lock case to a position in which its cam is in proper operating relation with the bolt it is to actuate. The housing is secured in place by a retaining screw, and its opposite end is fitted with a core with the use of a control key. This completes the operative assembly. The projecting ends of the cylinder housing are desirably enclosed with decorative cylinder rings held in place by the usual escutcheons at the two faces of the door.

With the cylinder housing so mounted, it cannot be removed from the mortise lock case wthout first removing one of the cores with the use of a special control key, since those cores have bottom lobes wider than the opening in the mortise lock case, and even if the cylinder retaining screw is removed, the presence of the cores will prevent removal of the cylinder housing from the mortise lock case. This increases the security of the lock mechanism, as compared with the standard mortise lock of the type referred to, and also provides to the lock the several advantages of key-removable cores.

The accompanying drawings illustrate the invention and exemplify the best mode of carrying out the invention as presently perceived. In such drawings:

FIG. 1 is an exploded perspective view of a mortise lock case, together with a cylinder housing and two key-removable cores in accordance with the invention;

FIG. 2 is a perspective view of a prior art cylinder of a type used with the mortise lock case in accordance with the prior art;

FIG. 3 is a vertical section of a door installation containing a mortise lock mechanism as shown in FIG. 1;

FIG. 4 is a section taken on the line 4—4 of FIG. 1 showing an end view of the cylinder housing and the relationship of the bolt-actuating cam to the dead bolt of the mortise lock;

FIG. 5 is a perspective view of a decorative cylinder ring used to enclose the ends of the cylinder housing shown in FIG. 3;

FIG. 6 is an exploded view of the cam throw shuttle means mounted between the core chambers of the cylinder housing;

FIGS. 6A is a rear end elevation of a standard key-removable lock core;

FIG. 7 is an axial sectional view of the cylinder housing with the shuttle assembly shuttled to the right by a key in the left core; and FIG. 8 is a similar view showing the shuttle assembly shuttled to the left by a key in the right core.

The lock mechanism shown in the drawings comprises a mortise lock case 10 having side plates 12 and 14 and a face plate 16. A latch bolt 18 is mounted in the case for primary operation by a door handle 20 on a shaft 19, and a dead bolt 22 is mounted in the mortise lock case for key operation. Immediately below the shank 24 of the dead bolt 22, the side walls 12 and 14 are provided with keyhole-shaped openings 26 for the reception of a key-operated primary lock cylinder.

A conventional lock cylinder 30 of the prior art is shown in FIG. 2. This comprises a housing having an upper cylindrical lobe or barrel 32 which contains key plugs 34 in its opposite ends, and a depending radial flange 36 which contains the pin tumblers controlling the key plugs 34. The plugs 34 are mounted in cylinderical chambers in the opposite ends of the barrel 32, and a bolt-operating cam 38 having an actuating nose 40 is rotatably mounted coaxially with the barrel 32 and the two plugs 34. Cam actuating mechanism is operative to connect the two plugs 34 alternatively to the cam 38 to rotate that cam and thereby actuate the bolt 22. Insertion of a key in either key plug 34 is effective to connect that key plug to the cam and to disconnect the cam from the opposite key plug so that the key-containing plug will be operative to rotate the cam, and can rotate the same through 360° of movement.

For installation of this conventional cylinder 30, a conventional operating key is inserted in either of the plugs 34, and rotated to carry the nose 40 of the cam 38 into alignment with the flange 36. This allows the cylinder to be inserted through the openings 26 of the mortise lock case to a position in which the cam 38 lies between the side plates 12 and 14 and in operative relation with the shank 24 of the dead bolt 22. A retaining screw 42 is then inserted through the face plate 16 of the mortise lock into a threaded opening 44 in the flange 36 of the cylinder 30. The cylinder is then in operative position for operation by a key in either of the plugs 34, to actuate the dead bolt 22. To remove the cylinder 30 from the mortise lock case, the retaining bolt 42 is removed, a normal operating key is inserted in one of the plugs 34 and that plug is rotated to carry the nose 40 of the cam 38 into alignment with the flange 36, and the cylinder 30 is then withdrawn axially from the mortise lock case.

In accordance with the present invention, instead of using the conventional cylinder 30 shown in FIG. 2 and described above, the mortise lock is fitted with an adaptation cylinder 50 as shown in FIGS. 1 and 3–8. Such cylinder 50 is provided with a core chamber 52 at each end, for the reception of a standard key-removable core 54. Such core 54 is of FIG. 8 cross section and includes an upper cylindrical key plug lobe 56 in which a key plug 58 is mounted, and a lower lobe 60 which contains the pin tumblers controlling the operation of the key plug 58. The core is adapted to be secured in place in its core chamber 52 by means of a retaining lug 62 which normally projects from one side of the core, as shown in FIG. 6A and at the upper left in FIG. 1, but which is retractable by the use of a special control key 64 to permit the core to be inserted and removed from its core chamber.

The adaptation cylinder 50 comprises a housing having an upper cylindrical lobe or barrel 66, and a depending radial flange 68, so that the adaptation cylinder 50 has the same external cross-sectional shape as the conventional cylinder 30 and is adapted to be inserted through the openings 26 in the side plates of the mortise lock case with the same fit as that conventional cylinder.

Each core chamber 52 comprises an upper lobe 70 adapted to receive the upper lobe 56 of a core 54. The lower lobe 60 of the core is wider than the rib 68, and that rib 68 and the lower portion of the barrel 70 are cut away to accommodate that lower core lobe 60. This leaves the upper lobe of the chamber defined by a circumferentially incomplete cylindrical wall, open at the bottom. Inward from the outer end of each chamber 70, the cylindrical wall is cut away at each side to form a shoulder 72, behind which the retaining lug 62 of the core 54 (shown in FIG. 6A and at the left in FIG. 1) is adapted to engage, to retain the core 54 in the chamber.

The adaptation cylinder 50 has a rotary cam 74 rotatably mounted on the axis of the barrel 66. The cam has a cam nose 76 which is shown in FIG. 4 in a normal position extending at an angle downward and offset from the lower flange, in a position which would block passage of the cylinder 50 through the openings 26 of the side plates of the mortise lock case. Accordingly, before inserting the cylinder 50 in the lock case, it is convenient to insert a core 54 in a chamber 52 at one end of the adaptation cylinder, with the use of a control key 64 shown in FIG. 1, and then to operate that core 54 with an operating key 80 as shown in FIGS. 7 and 8 to rotate the cam nose 76 into alignment with the bottom flange 68 of the adaptation cylinder. This allows the end of such cylinder which does not contain a core 54 to be inserted through the standard opening 26 of the mortise lock case to carry the cam 74 and its nose to a position between the side plates 12 and 14 of such case and thus into operating relation with the shank 24 of the dead bolt 22. A retaining bolt 42 is then inserted and threaded into the hole 44 of the cylinder 50. A second core 54 is then inserted in the core chamber 52 at the opposite end of the adaptation cylinder 50, so that the dead bolt 22 is key operable from either end of the cylinder.

When the adaptation cylinder 50 is inserted in a mortise lock case 10 mounted in a door 83, the ends of the cylinder will normally project beyond the faces of the door. Those projecting ends are decoratively enclosed and protected by cylinder rings 82 as shown in FIGS. 3 and 5 of a selected length to suit the thickness of the door. The rings 82 are held in place by the usual escutcheon plates 84 mounted against the opposite faces of the door. A handle 20 is mounted at each end of the shaft 19 which controls the latch bolt 18 of the mortise lock, and are desirably rotatably supported in the escutcheon plates.

The mounting of the bolt-operating cam 74 and its interconnection with the two cores 54 is shown in FIGS. 6-8. The cam 74 is formed as a short cylindrical ring, with a clutch-driven tooth or lug 86 intermediate its ends, here shown as a narrow segment having an inner chordal face formed integral with the ring body of the cam 74. The cam nose 76 is integrally attached to the ring, and projects radially therefrom. The ring 75 of the cam surrounds and is supported by two shuttle throw plugs 88 and 90 mounted in a cylindrical bore 92 which extends between and coaxial with the upper lobes 70 of the chambers 52 in the barrel 66 of the cylinder. Such throw plugs are of short cylindrical shape and are rotatable in the bore 92. At their inner faces, the two throw plugs are each provided with a chordal groove which provides a chordal face 93 adapted to fit against the face of the driven clutch lug 86 of the cam 74, and thus constitute a clutch driving element for transmitting rotation from the throw plugs 88 or 90 to that clutch driven element 86 and thence to the cam 74. As shown in FIGS. 7 and 8, the two clutch driving elements 93 are spaced from each other by the presence of circular raised lands 94 on the inner ends of the two throw plugs, so that they are alternatively engageable with the driven clutch element 86, and normally do not both engage that driven element at the same time. The two throw plugs 88 and 90 are rotatably interconnected by a connecting pin 96. Conveniently, such pin 96 is a shouldered pin which is rotatable in the throw plug 88 and is riveted in the throw plug 90.

For connecting the throw plugs 88 and 90 to the key plugs 58, each throw plug is provided with a pair of axially extending throw pins 98, adapted to be received in a corresponding pair of holes 100 (FIG. 6A) which extend forward from the inner end of the key plug. The pins are riveted or otherwise securely fixed in the throw plugs 88 and 90. A shuttle pin plate 102 is mounted against the outer face of each throw plug 88 and 90, and may be secured in place by a press-fit on knurled bands at the base of the throw pins 98. Each such plate carries a shuttle shift pin 104 in position to enter the rear end of the key slot 59 of a core mounted in the adjacent core chamber 52.

Each shuttle shift pin is of such length that it will be engaged by the end of an operating key 80 inserted in the key slot 59, so that thurst on the key will cause the throw plug assembly to shuttle in a direction to cause the adjacent throw plug 88 or 90 to be clutched to the driven clutch lug 86 of the cam 74, whereby rotation of the key and key plug of the core will cause rotation of the cam 74 and its nose 76 to actuate the dead bolt 22.

As shown in FIG. 7, a key 80 is inserted in the key plug of the core 54 at the left end of the adaptation cylinder 50. The inner end of the key 80 engages the shift pin 104 mounted on the throw plug 90, and thrusts the throw plug assembly to the right. This carries the driving clutch element 93 of that throw plug 90 into engagement with the driven clutch element 86 of the cam 74. It simultaneously moves the clutch driving element 93 of the throw plug 88 out of engagement with the driven clutch element 86. The result is that the inserted key 80 can act through the throw plug 90 to rotate the cam 74, without also rotating the throw plug 88 which is non-rotatably connected to the locked key plug 58 of the core 54 at the opposite end of the cylinder.

Conversely, as shown in FIG. 8, when an operating key 80 is inserted in the key plug 58 of the core at the right end of the cylinder, its inner end strikes the shift pin 104 connected to the throw plug 88, and thrusts the throw assembly to the left so as to engage the driving clutch element 93 with the driven clutch element 86 of the cam 74 and concurrently to disconnect that driven clutch element from the opposite throw plug 90. The right-end key can then turn the key plug 58 connected to the throw plug 88 and hence turn the cam 74 without turning the throw plug 90 which will be locked against rotation by the lock core at the opposite end of the cylinder.

Rotation of the cam 74 by a key in either end of the adaptation cylinder 50 will actuate the dead bolt 22 either to advance it or retract it. As shown in FIG. 4, the cam nose 76 normally lies at a downward angle at one side of the flange 68 of the cylinder. The shank 24 of the dead bolt 22 is shown in retracted position, and is provided with a cam notch 25 which in this position lies in the path of counterclockwise rotation of the cam nose 76. Such rotation carries the cam nose into the notch 25 and drives the bolt shank 24 to the left to the advanced position shown in dotted lines. The cam nose 76 then leaves the cam notch and is continued in counterclockwise rotation back to its original position, at which point the key 80 will have returned to its original position and can be withdrawn from the core, leaving the bolt locked. The bolt is unlocked by a reverse of this procedure, that is, a key is inserted in one of the cores, it shifts the throw plug assembly in a direction to clutch the associated throw plug 88 or 90 to the driven clutch element 86 of the cam 74, and the cam is then rotated by the key in a clockwise direction to carry it first into the cam notch in the advanced position of that cam notch shown in dotted lines in FIG. 4, and upon further clockwise rotation, it shifts the bolt to retracted position as shown in full lines in FIG. 4.

The adaptation cylinder 50 can replace the standard cylinder 30 in substantially any door installation. The standard mortise lock remains identically the same and is mounted in identically the same way as in the standard installation. To insert the adaptation cylinder 50, a core 54 is first mounted in the core chamber 52 at one end of such cylinder, with the use of a special control key 64. The cam 74 will be in an angular orientation as shown in FIG. 4, and will appear to lie either to the right, as shown, or to the left of the bottom flange 68, depending upon which end of the cylinder 50 receives the core 54. The control key 64 is then removed, and an operating key 80 is inserted in the key plug 58. As explained in connection with FIGS. 7 and 8, the inner end of the operating key engages the shift pin 104 and shifts the throw plug assembly so as to connect the throw plug driven by the key into clutching engagement with the cam 74. The cam is then rotated to carry its nose 76 into alignment with the flange 68, and the cylinder 50 can then be inserted through prepared openings in the door 83 and the shaped openings 26 in the side plates 12 and 14 of the mortise lock case. This brings the cam 74 into operating relation with the shank 24 of the dead bolt 22, and the cylinder is secured in place by insertion of a retaining screw 42 and threading it into the hole 44 of the cylinder. The operating key can then be returned to its normal position and withdrawn, which will leave the cam nose 76 in a normal position as shown in FIG. 4. A core 54 is then inserted in the opposite end of the cylinder 50. The cylinder trim rings 82 and the escutcheons 84 and handles 20 are then installed.

The adaptation cylinder 50 is thus interchangeable with the prior art conventional cylinder 30. Whereas the conventional cylinder did not have key-removable cores, the adaptation cylinder 50 has key-removable cores 54 and provides all the advantages of such key-removable cores. Further, the presence of the key-removable cores enhances the security of the lock. Since the cores have lower lobes 60 which are wider than the flange 68 and wider than the lower portion of the shaped openings 26 in the side plates 12 and 14 of the mortise lock case, the presence of cores in both ends of the cylinder 50 will obstruct removal of the cylinder from the mortise lock case unless at least one of those cores is removed by means of a special control key 64. While the conventional cylinder 30 requires the use of a key to rotate the nose 40 of the cam 38 into alignment with the flange 36 to permit that flange to pass through the shaped openings 26 of the mortise lock case, the key required is only an operating key, so that any ordinary operating key can be used to remove the cylinder. This is not possible with the adaptation cylinder, since it requires removal of one of the cores with the use of a special control key.

I claim:

1. A double-ended lock cylinder adapted to be mounted through a conforming opening in a mortise lock case for key operation of a bolt therein, comprising an elongated cylinder housing having a cylindrical barrel and a radially protruding flange extending axially of the barrel, at least one end of such housing having a cross sectional shape to pass through such conforming opening, core chambers formed in the opposite ends of the housing for the reception therein of key-removable cores each having a portion containing a key plug and a laterally connected portion forming a tumbler housing, such chambers being formed to dispose the key plugs of the two cores coaxially in the barrel and including means adjacent such chambers for engagement by core retaining means for the cores mounted therein, cam-throw shuttle means mounted in said cylinder housing between said chambers for axial and rotative movement on the axis of the key plugs of cores received in the chambers, said shuttle means including two relatively rotatable throw members, each having a driving clutch element thereon, a bolt-actuating cam rotatably mounted about said shuttle means and having driven clutch means disposed for alternative engagement by the driving clutch elements of said throw members as the same are shuttled into engagement therewith, throw means for connecting each of said shuttle throw members for rotation by the key plug of a core mounted in the adjacent core chamber, and shuttle actuator means for each shuttle throw member, positioned for engagement by a key in the key plug of a core in the adjacent chamber so that insertion of such key will shuttle the shuttle assembly so as to clutch the throw element connected to such plug to the bolt-actuating cam.

2. A lock cylinder as in claim 1 in which the core chambers are formed to receive key-removable cores in a position in which at least one core projects beyond the side of the cylinder housing so as to block passage of the core-retaining end of the housing from passage through the conforming opening of a lock case.

3. A lock cylinder as in claim 2 in which both chambers are formed to receive key-removable cores in removal blocking position so as to prevent removal of the housing except by key-removal of at least one core.

4. A lock cylinder as in claim 2 in combination with a core mounted in each so-formed chamber and projecting beyond the side of the housing to block such removal passage.

5. A lock cylinder as in claim 3 in combination with a core mounted in each so-formed chamber and projecting beyond the side of the housing to block such removal passage.

6. A lock cylinder as in claim 4 in which the core includes a core-retaining element operable by a special control key combinated differently than a normal operating key.

7. A lock cylinder as in claim 5 in which each core includes a core-retaining element operable by a special control key combinated differently than a normal operating key.

8. A lock cylinder as in claim 1 in which said cam comprises a body positioned in a transverse slot in said barrel and said shuttle means comprises two cylindrical throw plugs rotatably mounted coaxially on the axis of said barrel and together extending across said cam-receiving slot, such plugs being rotatably interconnected to each other and supported in the barrel beyond the slots and the cam being rotatably supported by such throw plugs.

9. A lock cylinder as in claim 1 in which said throw means comprises a pair of parallel throw pins extending axially from each throw member into the adjacent core chamber for axially-separable engagement with corresponding holes in the key plug of a core mounted in such chamber.

10. A lock cylinder as in claim 1 in which said shuttle actuator means comprises a pin in position to project into the key slot of the key plug of a core mounted in the adjacent chamber.

11. A lock cylinder as in claim 9 in which said shuttle actuator means comprises a pin mounted between the throw pins thereon in position to project into the key slot of the key plug of a core mounted in the adjacent chamber.

12. A double-ended lock cylinder adapted to be mounted through a conforming opening in a mortise lock case to provide for key operation of a bolt therein, comprising an elongated cylinder housing having a cylindrical barrel and a radially protruding flange extending axially of the barrel so as to fit a comforming opening having a circular portion and a narrower slot extending radially therefrom, core chambers formed in the opposite ends of the housing for the reception therein of key-removable cores each having a cylindrical key-plug lobe of smaller diameter than said barrel and having a laterally projecting tumbler housing, each such chamber including a cylindrical lobe in the barrel for the reception of the key-plug lobe of the core and having a shoulder adjacent such cylindrical lobe for engagement by a core-retaining lug, a bolt-actuating cam mounted in a cross slot in the barrel axially between said two chambers, cam-throw shuttle means mounted in said cylinder housing between said cylindrical chamber lobes for axial and rotative movement in the housing, said shuttle means including two relatively rotatable throw members, which together extend across said slot, each throw member having a driving clutch element thereon, said bolt-actuating cam being rotatably mounted about said shuttle means and having driven clutch means disposed for alternative engagement by the driving clutch elements of said throw members as the same are shuttled into engagement therewith, throw means for connecting said shuttle throw members respectively for rotation by the key plugs of cores mounted in the core chambers, and a shuttle actuator for each shuttle throw member positioned for engagement by a key in the key plug of a core in the adjacent chamber so that insertion of such key will shuttle the shuttle assembly so as to clutch the throw element connected to such plug to the bolt-actuating cam.

13. A lock cylinder as in claim 12 in which said bolt-actuating cam has cylindrical inner bearing surfaces at its ends, and said two throw members are cylindrical bodies rotatably received within said bearing surfaces.

14. A lock cylinder as in claim 13 in which said cam has a clutch driven tooth formed between its cylindrical bearing surfaces and said throw members have notches cut therein to engage such tooth in clutching relation.

15. A lock cylinder as in claim 14 in which said driven tooth is a land projecting inward from said bearing surfaces and having a chordal inner face and said throw members are formed with a chordal notch for clutching engagement with said tooth from opposite sides thereof.

16. A lock cylinder as in claim 12 in combination with lock cores for said chambers, said lock cores being of FIG. 8 cross section and having a key plug first lobe and an intersecting parallel second lobe forming the pin tumbler housing, said second lobe having a diameter greater than the thickness of the flange of said cylinder housing, each core chamber having a cylindrical key plug lobe in the barrel of the housing and the barrel and housing flange being cut away to accommodate the second lobe of the core and allow the same to project beyond the sides of the flange so as to block passage of the flange through an opening conforming therewith.

17. A double-ended lock cylinder adapted to be mounted through a conforming opening in a mortise lock case for key operation of a bolt therein, comprising an elongated cylinder housing having a cylindrical barrel and a radially protruding flange extending axially of the barrel, at least one end of such housing having a cross-sectional shape to pass through such conforming opening, a core chamber formed in the said end of the housing for the reception therein of a key-removable core having a key-plug therein and a tumbler housing projecting laterally relative to the key plug, such chamber including a portion in the barrel for the reception of the key-plug portion of the core and means adjacent such chamber lobe for engagement by key-controlled core retaining means on the core, a rotatable throw member mounted in said cylinder for rotative movement on the axis of the key plug of a core received in the chamber, a bolt-actuating cam rotatably mounted on said key plug axis and means for connecting the cam for rotation by said cam throw member, and throw means for connecting said shuttle throw member for rotation by the key plug of a core mounted in the core chamber, said core chamber being formed to receive a key-removable core in a position in which the core projects beyond the side of the cylinder housing so as to block passage of the core-containing end of the housing from passage through the conforming opening of a lock case.

* * * * *